US007627931B2

(12) United States Patent
Breuer et al.

(10) Patent No.: US 7,627,931 B2
(45) Date of Patent: Dec. 8, 2009

(54) APPARATUS ON A CARDING MACHINE FOR PROCESSING TEXTILE FIBRES, FOR EXAMPLE COTTON, SYNTHETIC FIBRES AND THE LIKE, WITH A CYLINDER

(75) Inventors: Achim Breuer, Aachen (DE); Wilfried Weber, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 673 days.

(21) Appl. No.: 11/375,005

(22) Filed: Mar. 15, 2006

(65) Prior Publication Data

US 2006/0207065 A1 Sep. 21, 2006

(30) Foreign Application Priority Data

Mar. 15, 2005 (DE) ..... 10 2005 012 251

(51) Int. Cl.
*D01G 15/08* (2006.01)

(52) U.S. Cl. ..... 19/102; 19/104

(58) Field of Classification Search ..... 19/102, 19/104, 106 R

See application file for complete search history.

(56) References Cited

U.S. PATENT DOCUMENTS

| | | | | |
|---|---|---|---|---|
| 5,142,741 | A * | 9/1992 | Demuth et al. | 19/113 |
| 5,144,723 | A | 9/1992 | Hohloch et al. | |
| 6,189,184 | B1 * | 2/2001 | Pferdmenges et al. | 19/104 |
| 2004/0211037 | A1 * | 10/2004 | Breuer et al. | 19/98 |
| 2004/0226143 | A1 * | 11/2004 | Breuer et al. | 19/98 |

FOREIGN PATENT DOCUMENTS

| | | | |
|---|---|---|---|
| AT | 397970 | B | 12/1993 |
| DE | 39 02 202 | | 8/1990 |
| DE | 101 10 824 | A1 | 6/2002 |
| DE | 102 07 159 | | 8/2003 |
| DE | 103 18 968 | | 11/2004 |
| EP | 0260231 | A1 | 3/1988 |
| EP | 06 87 754 | | 12/1995 |
| GB | 2025476 | A | 1/1980 |
| GB | 2376244 | A | 12/2002 |

OTHER PUBLICATIONS

British Search Report, dated Jul. 5, 2006, based on corresponding British Application No. GB0604594.2.

* cited by examiner

*Primary Examiner*—Shaun R Hurley
(74) *Attorney, Agent, or Firm*—Venable LLP; Robert Kinberg; Steven J. Schwarz

(57) ABSTRACT

An apparatus on a carding machine for processing textile fibres, with a cylinder, has, in the preliminary carding zone, after carding zone and/or underneath carding zone, covering elements which lie opposite the cylinder clothing. A fixed carding element is associated with at least one cover element. The spacing of the cylinder clothing from the clothing of the fixed carding element is smaller than the spacing from the cover element. In order to reduce nep formation, to allow improved carding work and to give a better carding result, between at least one clothing strip of the fixed carding element and a cover element arranged upstream and/or downstream thereof, there is arranged an air guide element the spacing of which with respect to the cylinder clothing gradually decreases or increases.

21 Claims, 7 Drawing Sheets

APPARATUS ON A CARDING MACHINE FOR PROCESSING TEXTILE FIBRES, FOR EXAMPLE COTTON, SYNTHETIC FIBRES AND THE LIKE, WITH A CYLINDER

CROSS REFERENCE TO A RELATED APPLICATION

The present application claims priority from German Patent Application No. 10 2005 012 251.5, dated 15 Mar. 2005, the entire disclosure of which is incorporated herein by reference.

BACKGROUND OF THE INVENTION

The invention relates to an apparatus on a carding machine for processing textile fibres, for example cotton, synthetic fibres and the like, with a cylinder. Generally, in such an apparatus, in the preliminary carding zone, after carding zone and/or underneath carding zone, covering elements lie opposite the cylinder clothing, and a fixed carding element is associated with at least one cover element, the spacing of the cylinder clothing with respect to the clothing of the fixed carding element (carding nip) being smaller than the spacing with respect to the cover element.

In practice, covering elements are located only a small distance apart from the clothed outer surface of the high-speed cylinder. In addition to cover plates without clothing there are also routinely present clothed fixed carding elements having at least one clothing strip. In many cases, relatively short non-clothed cover profiles extend tangentially to the cylinder clothing.

In a known apparatus (EP 0 687 754 A) a cylinder casing segment is provided which serves as support for three fixed carding bars. Upstream of the first (seen in the direction of rotation of the cylinder) fixed carding bar (clothing strip), the cylinder casing segment has a non-clothed extension piece which covers the cylinder. The surface of the extension piece is flat and extends parallel to the cylinder clothing. Furthermore, the spacing between the extension piece and the cylinder clothing in the circumferential direction of the cylinder is throughout larger than the spacing between the clothing of the fixed carding element and the cylinder clothing. In particular, the spacing of the end of the extension piece associated with the fixed carding element with respect to the clothing of the fixed carding element is substantial, and there is a step. As a result, air turbulence occurs upstream of the fixed carding element, which in an undesirable manner results in increased nep formation in the fibre material. A further problem is that the turbulence leads to an increased pressure difference at the fixed carding elements, to increased heating of the components involved, to higher fibre loading and to clogging of the clothing strips of the fixed carding elements.

It is an aim of the invention to provide an apparatus of the kind described at the beginning that avoids or mitigates the mentioned disadvantages, that especially reduces nep formation, allows improved carding work and gives a better carding result.

SUMMARY OF THE INVENTION

The invention provides a carding apparatus comprising:

a carding cylinder;

a fixed carding element having a clothed surface opposed, at a first spacing, to the cylinder;

a cover element opposed to the cylinder at a second spacing greater than said first spacing; and an air guide element arranged between said cover element and said carding element and so positioned that the spacing of the air guide element from the cylinder in the region of the cover element is greater than the spacing of the air guide element in the region of the fixed carding element.

By allowing gradual reduction of the spacing between the air guide element and the cylinder clothing to a spacing that is the same as or smaller than the spacing between the cylinder clothing and the clothing of the fixed carding element, or the at least one clothing strip, troublesome air turbulence upstream or downstream of the fixed carding element can be avoided. The air entrained by the cylinder can flow smoothly into or out of the carding nip between the cylinder and the fixed carding element. According to the invention, a flow guide element is mounted upstream and/or downstream of the fixed carding element so that fibres and air are continuously supplied to the narrow carding nip or are conveyed away from the carding nip, that is to say the space upstream of the carding element becomes successively narrower or wider. In respect of the cylinder clothing, the narrowest cover profile spacing is brought nearer to the tip spacing of the fixed carding element. In particular, the first tips of the clothing strip of the fixed carding element are, in terms of flow, covered or overlapped by the air guide element. Because the turbulence upstream or downstream of a fixed carding element is minimised or avoided, the following advantages inter alia are achieved: more uniform carding with a higher level of nep reduction, that is to say better quality; less heat generated by the machine as a whole; pressure differences at the cylinder reduced; loading on the first tips of a carding element minimised, because those tips are covered in terms of flow; more uniform distribution of the fibres, that is to say more homogeneous carding over the length of the carding elements; and less wear to clothings on the fixed carding elements. A considerable improvement both in the carding operation and the carding result (fibre web, sliver) is thereby achieved.

There may be an air guide element arranged upstream of the fixed carding element, the spacing—seen in the direction of rotation of the cylinder—gradually decreasing. As well or instead there may be an air guide element arranged downstream of the fixed carding element, the spacing—seen in the direction of rotation of the cylinder—gradually increasing. Advantageously, the spacing of the end of an upstream air guide element that is associated with the fixed carding element is the same as or smaller than the spacing between the clothing of the fixed carding element and the cylinder clothing. Advantageously, the spacing of the end of a downstream air guide element is the same as or smaller than the spacing between the clothing of the fixed carding element and the cylinder clothing. The cover element may be a cover profile, for example an extruded profile. Advantageously, in respect of the cylinder clothing the spacing of the end of the cover element that is associated with the air guide element and the spacing of the end of the air guide element that is associated with the cover element are substantially the same, and may be, for example, about $^{40}/_{1000}$". Advantageously, the spacing between the cylinder clothing and the clothing of the fixed carding element is about from $^{13}/_{1000}$" to $^{15}/_{1000}$". Advantageously, the spacing of the air guide element with respect to the cylinder clothing is adjustable. In one preferred arrangement, the end of the air guide element that faces the cover element is mounted on a pivot bearing. Advantageously, the spacing of the end of the air guide element that faces the fixed carding element with respect to the cylinder clothing is adjustable. Advantageously, the angle between the air guide element and a tangent on the cylinder clothing is adjustable, and is preferably adjustable in the range of about from 0.2° to 7°.

Advantageously, the fixed carding element has at least one clothing strip. Advantageously, the clothing of the at least one clothing strip is flat. Instead, the clothings of the clothing strip may be arranged at an angle to one another.

In one arrangement according to the invention, the air guide element is a separate component. In another arrangement of the invention, the air guide element is integrated into the frame of the fixed carding element. For example, the air guide element may be arranged upstream and/or downstream in the frame of a clothing strip. Advantageously, the air guide element is arranged adjacently in the frame of a clothing strip. Advantageously, the air guide element is part of the frame and is arranged upstream and/or downstream of the at least one clothing strip. The air guide element may instead be mounted outside on the frame.

The air guide element may consist of a flat plate or the like. The air guide may instead have a curved shape which faces the cylinder clothing. Advantageously, there is a clothing on the surface of the air guide element that faces the cylinder clothing. It is preferred that the size of the angle of the guide element relative to the cylinder be such that it does not cause separation of the air flow.

In an advantageous embodiment, a pivot joint for the air guide element is connected to a drive device, for example, a motor. Advantageously, the drive device is connected to an electronic control and regulation device Advantageously, the air guide element is automatically adjustable. Advantageously, the spacing of the air guide element with respect to the cylinder clothing is automatically adjustable.

In accordance with the invention, a carding apparatus as defined including an air guide element may be arranged in one or more of the preliminary carding zone, and the region between the licker-in and the rear card top guide roller. Where present, the drive device for the air guide element may be manually operable. Where present, a pivot joint for the air guide element may be mounted on the cover element. The air guide element may be a part of the cover element. The air guide element may be formed integrally on the cover element.

The invention also provides an apparatus on a carding machine for processing textile fibres, for example cotton, synthetic fibres or the like, with a cylinder, wherein, in the preliminary carding zone, after carding zone and/or underneath carding zone, covering elements lie opposite the cylinder clothing and wherein a fixed carding element is associated with at least one cover element, the spacing of the cylinder clothing with respect to the clothing of the fixed carding element (carding nip) being smaller than the spacing with respect to the cover element, in which between at least one clothing strip of the fixed carding element and a cover element arranged upstream and/or downstream of the fixed carding element—seen in the direction of rotation of the cylinder—there is arranged an air guide element the spacing of which with respect to the cylinder clothing gradually decreases or increases.

DETAILED DESCRIPTION OF CERTAIN PREFERRED EMBODIMENTS

Figure 1:
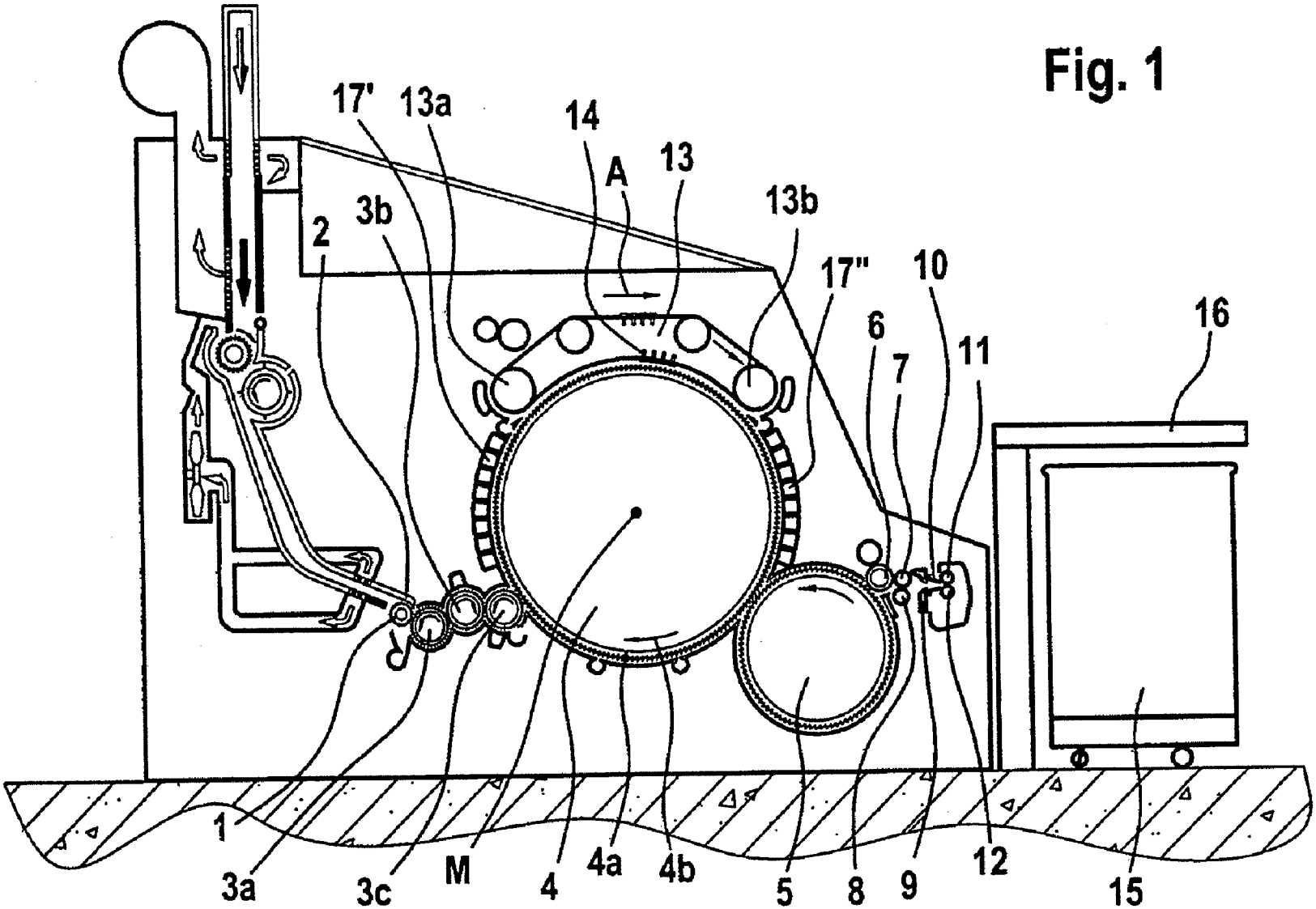
FIG. 1 is a diagrammatic side view of a carding machine having an apparatus according to the invention.

With reference to FIG. 1, a carding machine, for example, a flat card TC 03 (Trade Mark) made by Trützschler GmbH & Co. KG. of Mönchengladbach, Germany, has a feed roller 1, feed table 2, lickers-in 3*a*, 3*b*, 3*c*, cylinder 4, doffer 5, stripper roller 6, nip rollers 7, 8, web guide element 9, sliver funnel 10, delivery rollers 11, 12, revolving card top 13 with card top guide rollers 13*a*, 13*b* and flat bars 14, can 15 and coiler 16. The directions of rotation of the rollers are indicated by curved arrows. Reference letter M denotes the centre point (axis) of the cylinder 4. Reference numeral 4*a* denotes the clothing and reference numeral 4*b* the direction of rotation of the cylinder 4. An apparatus 17' according to the invention is arranged in fixed position between the licker-in 3*c* and the rear card top guide roller 13*a*, and an apparatus 17" according to the invention is arranged in fixed position between the forward card top guide roller 13*b* and the doffer 5. The arrow A indicates the working direction. The curved arrows drawn inside the rollers indicate the directions of rotation of the rollers.

Figure 2:
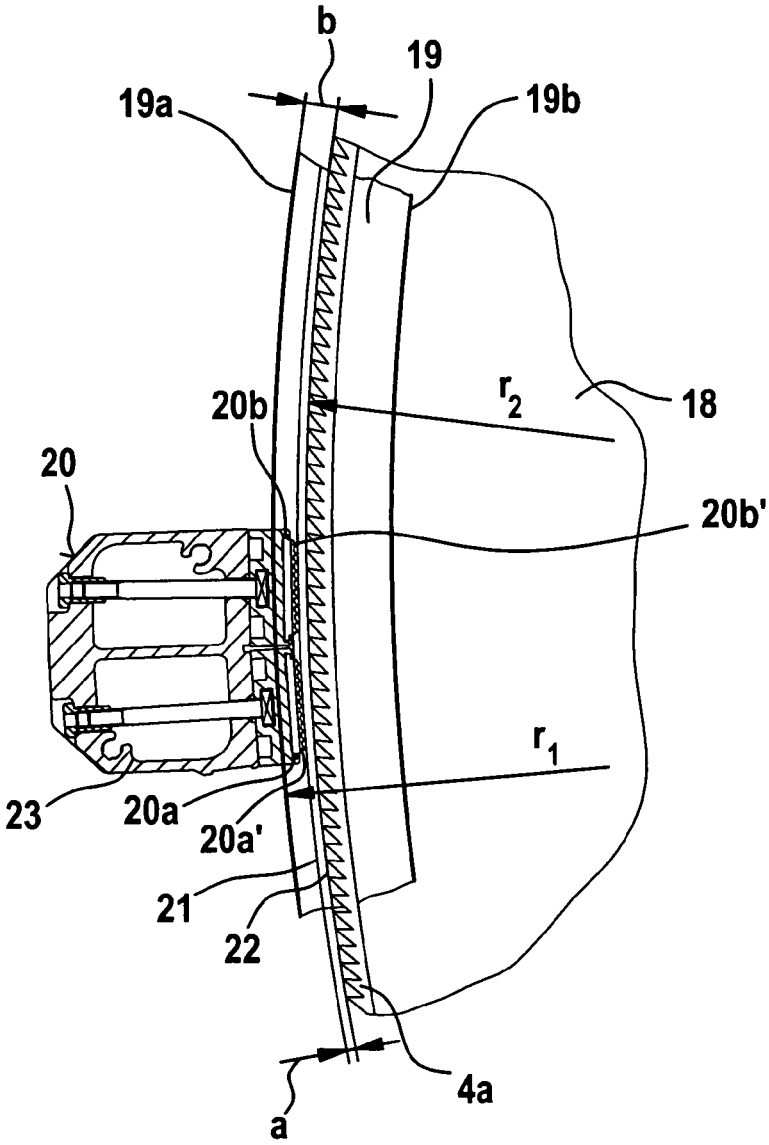
FIG. 2 shows a carding segment, a portion of a side panel with spacing between the carding segment clothing and cylinder clothing.
Figure 2A:
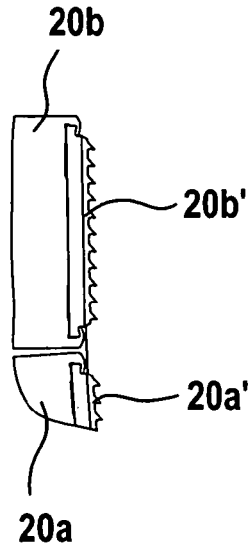
FIG. 2*a* shows the carding elements according to FIG. 2 in detail.

Referring to FIG. 2, on each side of the carding machine there is mounted, laterally on the machine frame (not shown), an approximately semi-circular rigid side panel 18 which has, integrally formed concentrically on its outer side in the region of the periphery, a curved rigid bearing element 19 having as support surface a convex outer surface 19*a* and an underside 19*b*. The apparatus 17', 17" according to the invention comprises at least one fixed carding element 20 having at its two ends bearing surfaces which rest on the convex outer surface 19*a* of the bearing element (for example curved extension piece). Carding elements 20*a*, 20*b* having clothing strips 20*a*', 20*b*' (carding clothings) mounted on the lower surface of the fixed carding element 20, as shown in FIG. 2*a*. Reference numeral 21 denotes the circle of tips of the clothings. The cylinder 4 has a cylinder clothing 4*a*, for example sawtooth clothing, around its circumference. Reference numeral 22 denotes the circle of tips of the cylinder clothing 4*a*. The spacing between the circle of tips 21 and the circle of tips 22 is indicated by reference letter a and is, for example, 0.20 mm. The spacing between the convex outer surface 19*a* and the circle of tips 22 is indicated by reference letter b. The radius of the convex outer surface 19*a* is indicated by reference letter $r_1$ and the radius of the circle of tips 22 is indicated by reference letter $r_2$. The radii $r_1$ and $r_2$ intersect at the centre point M of the cylinder 4. The carding segment 20 according to FIG. 2 consists of a support 23 and two carding elements 20*a*, 20*b* which are arranged one after the other in the direction of rotation (arrow 4*b*) of the cylinder 4, the clothings 20*a*', 20*b*' of the carding elements 20*a*, 20*b* and the clothing 4*a* of the cylinder 4 lying opposite one another. The supporting body 23 consists of a hollow aluminium profile and has continuous cavities.

Figure 3:
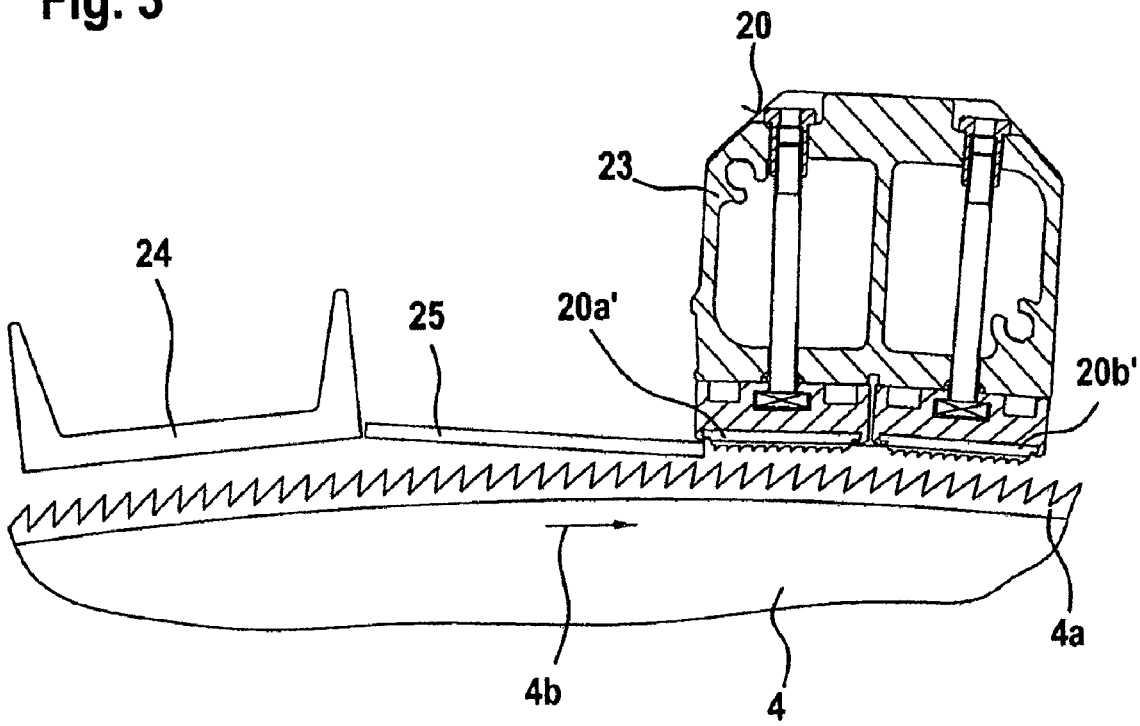
FIG. 3 is a side view of an apparatus according to the invention in which an air guide element is arranged between a clothing strip of a fixed carding element and an upstream cover profile.
Figure 3A:
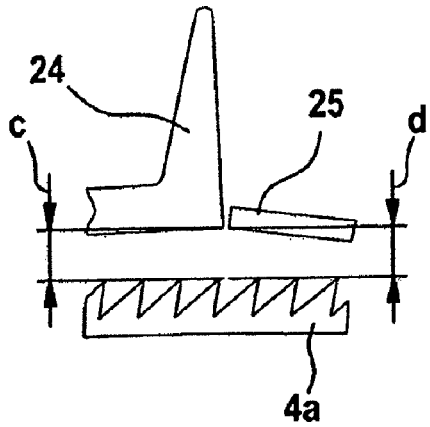
FIG. 3*a* shows the spacing of the boundary region between the cover profile and the air guide element with respect to the cylinder clothing.
Figure 3B:
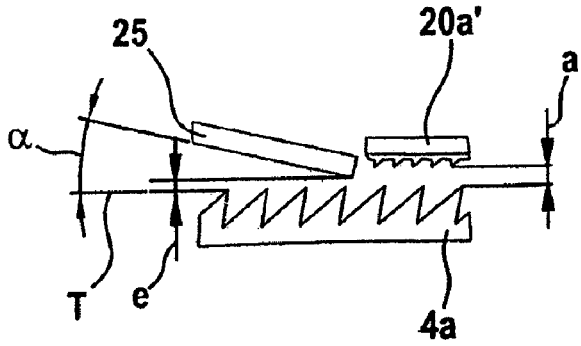
FIG. 3*b* shows the boundary region between the cover profile and a clothing strip and the spacings between the cylinder clothing and the cover profile and the clothing strip.

In the embodiment of FIG. 3, between the clothing strip 20*a*', of the fixed carding element 20 and an upstream—seen in the direction of rotation 4*b* of the cylinder 4—cover profile 24, for example an extruded aluminium profile, there is arranged an air guide element 25 the spacing of which with respect to the cylinder clothing 4*a* —seen in the direction of rotation 4*b* of the cylinder 4—gradually decreases. As FIG. 3*a* shows, in respect of the cylinder clothing 4*a* the spacing c of the end of the cover element 24 associated with the air guide element 25 and the spacing d of the end of the air guide element 25 associated with the cover element 24 are the same, for example 40/1000". According to FIG. 3*b*, the spacing e, for example 12/1000", of the end of the upstream air guide element 25 that is associated with the clothing strip 20*a*' of the fixed carding element 20 is smaller than the spacing a, for example 14/1000", between the clothing of the clothing strip 20*a*' and the cylinder clothing 4*a*. The surface of the air guide element 25 that faces the cylinder clothing 4*a* is flat and arranged at an acute angle α, for example 0.6°, to a tangent T at the tips of the cylinder clothing 4*a*. In this way, as a result of the air guide element 25 the relatively large spacing of the cover profile 24 with respect to the cylinder clothing 4*a* is gradually or successively brought closer to the spacing of the fixed carding segment 20 with respect to the cylinder clothing 4*a*. The air guide element 25 consequently acts as a flow guide element, so that fibres and air are continuously supplied to the narrow carding nip a, that is to say the space upstream of the carding element 20 becomes successively narrower. Air turbulence is avoided. Because the first tips of the clothing strip 20*a*' are overlapped by the end of the air guide element 25, the loading on the first tips is reduced. In addition, the carding is more gentle, because contact between the stream of fibres and the clothing strips 20*a*', 20*b*' is not concentrated on the first tips but is also spread out after the first tips.

The plane of the tips of the clothing strip 20*a*' can be flat, the narrowest spacing a with respect to the curved cylinder clothing 4*a* being, for example, 0.25 mm. In that case, the spacing of the first tips with respect to the cylinder clothing 4*a* is greater than 0.25 mm. The first tips are inevitably overlapped when the end of the air guide element 25 is set at a spacing of 0.25 mm with respect to the cylinder clothing 4*a*.

Figure 4:
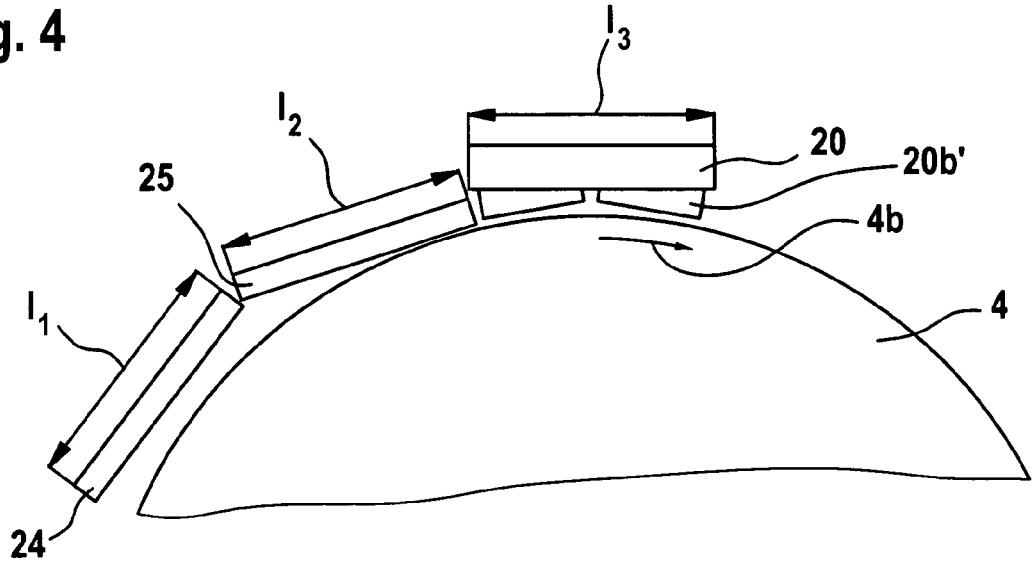
FIG. 4 indicates the lengths of the cover element, of the air guide element and of the fixed carding element.

In the embodiment of FIG. 4, the cover profile 24 can have a length $I_1$=70 mm, the air guide element 25 a length $I_2$=70 mm and the fixed carding element 20 a length $I_3$=70 mm. Equal lengths $I_1$, $I_2$ and $I_3$ are advantageous for a modular structure. The angle 60 (see FIG. 3*b*) can have the following pairs of values, including appropriate respective intermediate values, in relation to the length $I_2$ of the air guide element 25:

| α[°] | $I_2$[ mm] |
|---|---|
| 0.6 | 70 |
| 7 | 6 |

Figure 5:
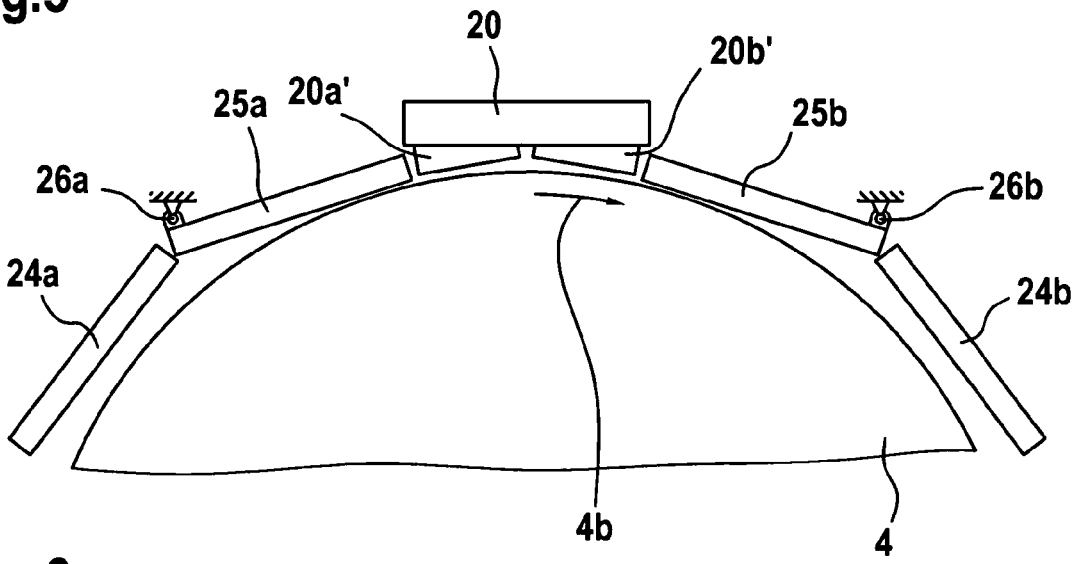
FIG. 5 shows a fixed carding element having two clothing strips, upstream and downstream of each of which there is arranged an air guide element in each case mounted on a pivot joint.

In the arrangement of FIG. 5, the end of the upstream air guide element 25*a* that faces the upstream cover element 24*a* is mounted on a pivot joint 26*a*. It is thus possible to adjust the angle a and therewith the spacing e (see FIG. 3*b*) of the end of the air guide element 25*a* that faces the fixed carding element 20 with respect to the cylinder clothing 4*a*. The end of the downstream air guide element 25*b* that faces the downstream cover element 24*b* is articulated on a pivot joint 26*b*. It is thus possible to adjust the angle of the air guide element 25*b* with respect to the cylinder clothing 4*a*, and therewith the spacing of the end of the air guide element 25*b* that faces the fixed carding element 20 with respect to the cylinder clothing 4*a*.

The pivot joints 26*a*, 26*b* can be mounted on a stationary holding element, frame or the like (not shown). In another development, the pivot joints 26*a*, 26*b* can be mounted in fixed position on the cover profiles 24*a*, 24*b*, respectively.

Figure 6:
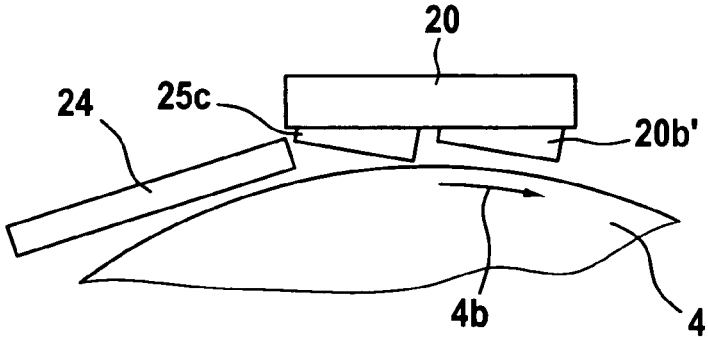
FIG. 6 shows an air guide element integrated into a fixed carding element support.

In the embodiment of FIG. 6, the stationary fixed carding element 20 contains an air guide element 25*c* instead of the clothing strip 20*a*' according to FIGS. 2 to 5. As a result, the air guide element 25*c* is integrated into the fixed carding element support (see FIGS. 2, 3). The first tips of the clothing strip 20*b*' are covered by the air guide element 25*c*.

Figure 7:
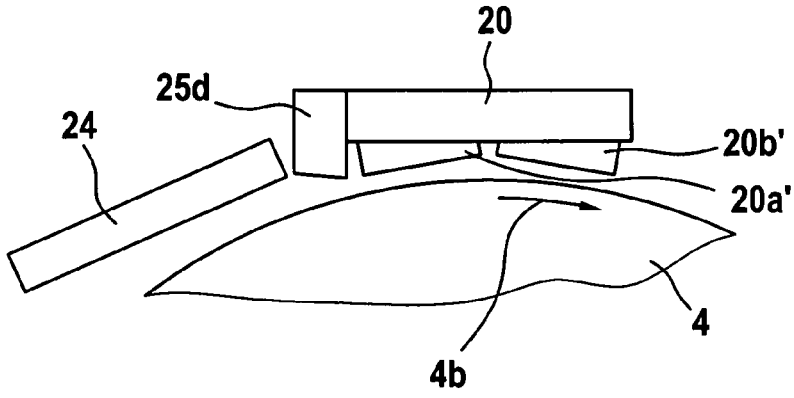
FIG. 7 shows an air guide element mounted upstream on the fixed carding element support.

In a further embodiment shown in FIG. 7, an air guide element 25*d* is mounted at the rear end—seen in the direction of rotation 4*b* of the cylinder—of the fixed carding element 23 (see FIGS. 2, 3). The air guide element 25*d* is arranged upstream of the clothing strip 20*a*'.

Figure 8:
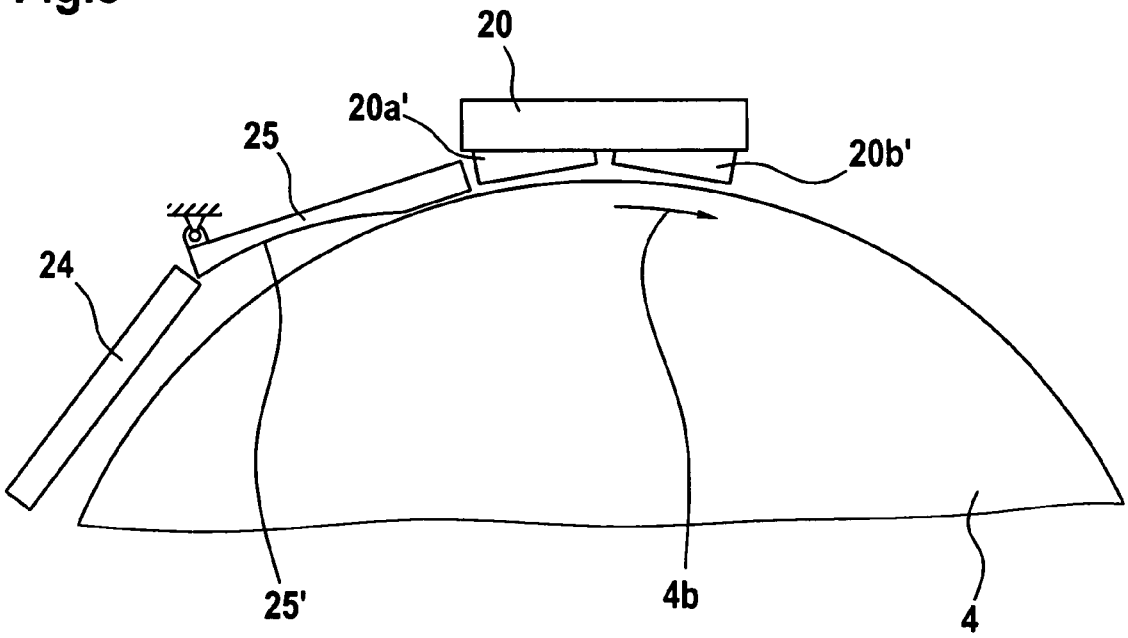
FIG. 8 shows an air guide element having a curved shape.

In the embodiment of FIG. 8, the air guide element 25 has a curved shape 25' on its surface that faces the cylinder clothing 4*a*.

Figure 9:
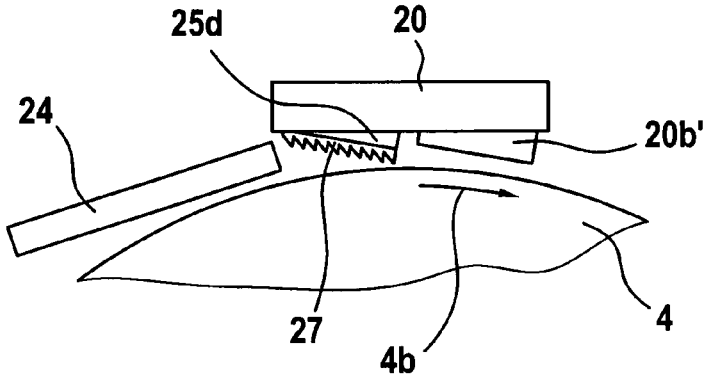
FIG. 9 shows an air guide element having clothing.

In the embodiment of FIG. 9, the air guide element 25*d* integrated into the fixed carding element support 23 has a clothing 27 on its surface that faces the cylinder clothing 4*a*.

Figure 10:
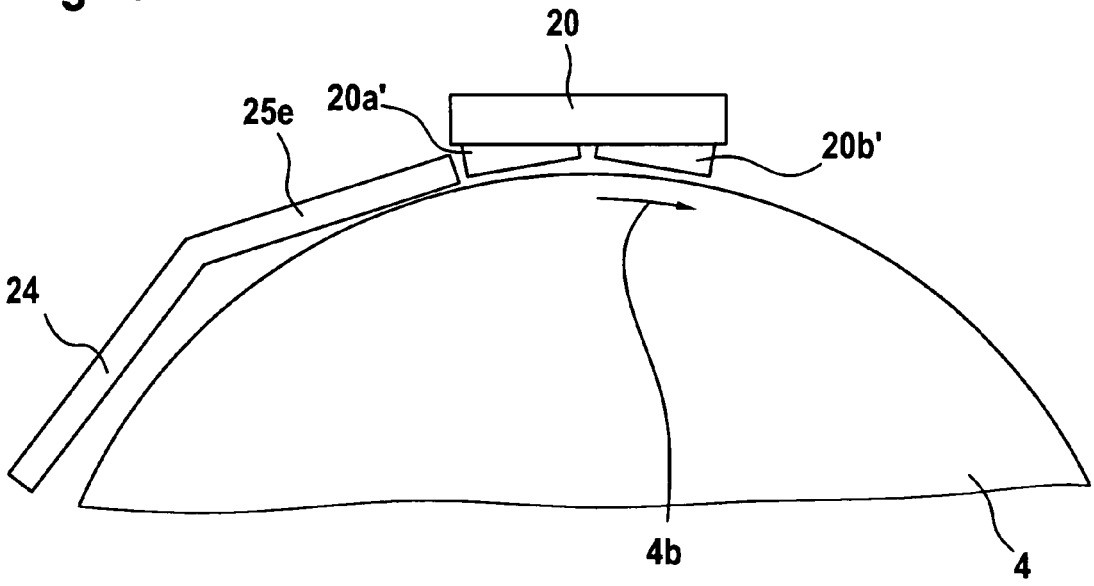
FIG. 10 shows an air guide element, integrated into a cover profile.

FIG. 10 shows an embodiment in which the air guide element 25*e* is formed integrally on the end of the cover element 24 that faces the fixed carding element 20. The air guide element 25*e* is thus integrated into the cover element 24.

Figure 11:
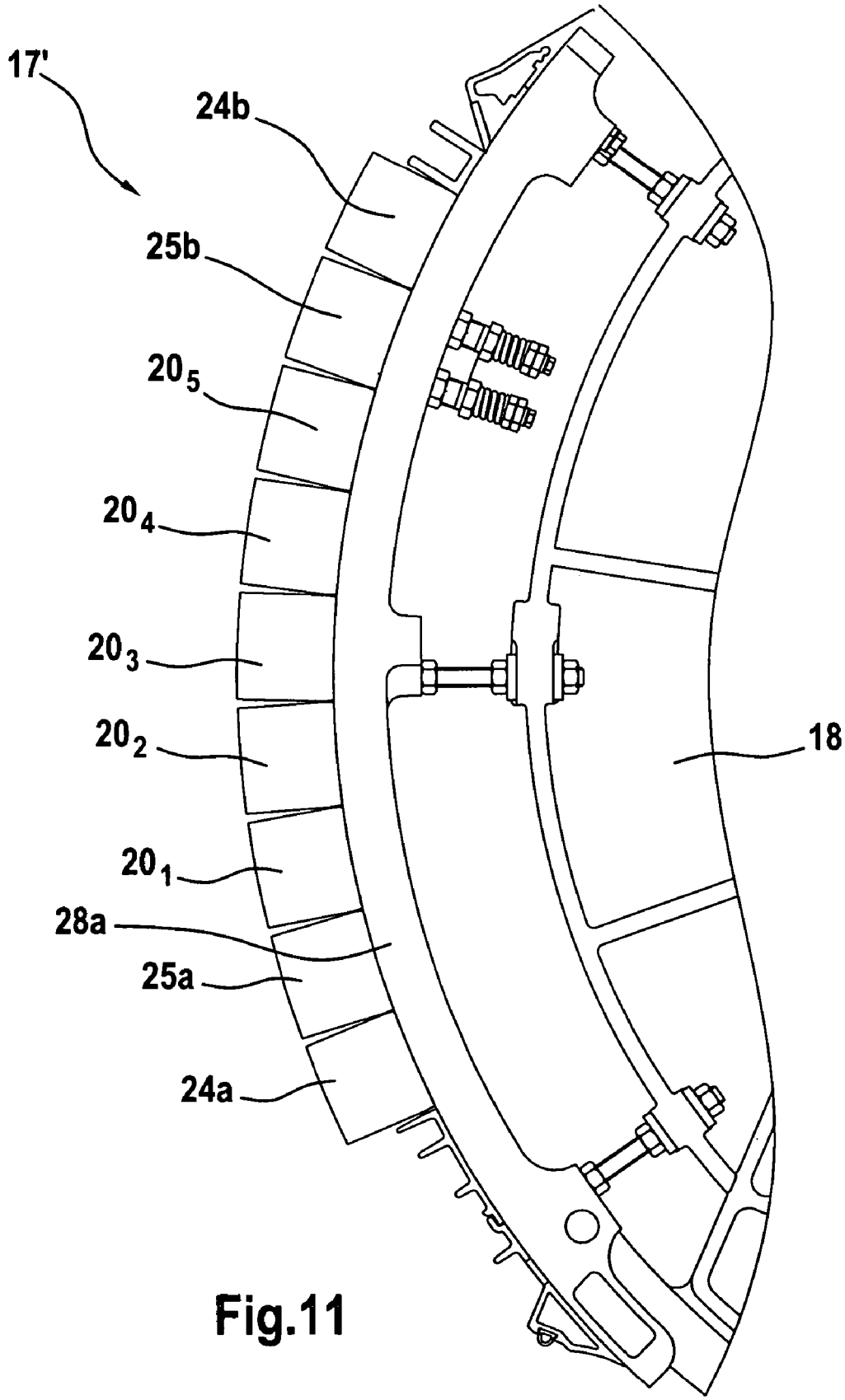
FIG. 11 shows an apparatus according to the invention in the preliminary carding zone with side panel and curved extension piece.

FIG. 11 shows a modular structure. Reference numerals 24*a*, 24*b* each denote a neutral cover profile; 25*a*, 25*b* each denote an air guide element; and $\mathbf{20}_1$, to $\mathbf{20}_5$ denote fixed carding elements, all the above-mentioned elements 24*a*, 24*b*; 25*a*, 25*b*; $\mathbf{20}_1$, to $\mathbf{20}_5$ being arranged on the curved extension pieces 28*a*, 28*b* (only 28*a* shown) of the carding machine. The curved extension pieces 28*a*, 28*b* are attached on each side of the carding machine to a carding machine panel 18*a* (see FIG. 2), 18*b*. FIG. 11 shows the arrangement of the apparatus 17' according to the invention between the licker-in 3*c* and the card top guide roller 13*a* (see FIG. 1). The apparatus 17" according to the invention can be arranged in corresponding manner between the card top guide roller 13*b* and the doffer 15 (see FIG. 1).

Upstream of a fixed carding element, which is usually positioned tangentially with respect to the cylinder 4, a flow guide element 25 is so mounted that fibres and air are supplied continuously to the narrow carding nip a, that is to say the space upstream of the carding element 20 becomes successively narrower. Because the turbulence upstream of a fixed carding element is minimised, the following advantages are obtained:

more uniform carding with a higher level of nep reduction, that is to say better quality;

less heat generated by the machine as a whole;

pressure differences at the cylinder reduced;

loading on the first tips of a carding element minimised, because those tips are covered in terms of flow;

more uniform distribution of the fibres, that is to say more homogeneous carding over the length of the carding elements;

less wear to clothings on the fixed carding elements.

On the licker-in side (see FIG. 1) there are more likely to be tangled fibres, which are processed by the apparatus 17'.

When fixed carding elements 20 are used, two points are important:

the carding action conditional on the first tips of the clothing strip;

the flow at the carding strip 20*a*', 20*b*'.

If gentle carding is preferred, the stream of fibres should not strike the first tips but should rather make contact with the clothing strip after those tips.

In the known apparatus, turbulence occurring upstream of a clothing strip can be identified by the fact that there are no deposits in the form of trash and dust between the first tips of a clothing strip, but instead such deposits are not found, even on the base of the clothing, until 7 mm after the first tips. As a result of the turbulence upstream of the fixed carding element, the flow even by-passes the first tips. The apparatus 17', 17" according to the invention avoids such turbulence.

According to the invention, the narrowest guide profile spacing is advantageously brought closer to the tip spacing of the fixed carding element, more advantageously with the air guide element even being in the same position as or overlapping the first tips of the fixed carding element. Overlapping automatically occurs when a fixed carding element is set to a spacing of 0.25 mm with respect to the cylinder and the guide element is likewise set to that spacing of 0.25 mm. Because the fixed carding element is usually mounted tangentially with respect to the cylinder, the curvature of the cylinder results in there being a larger spacing between the tips of the fixed carding element and the cylinder at the beginning and end of the fixed carding element and accordingly results in significant overlapping.

Although the foregoing invention has been described in detail by way of illustration and example for purposes of understanding, it will be obvious that changes and modifications may be practised within the scope of the appended claims.

What is claimed is:

1. A carding apparatus comprising:

a carding cylinder;

a fixed carding element having a clothed surface opposed, at a first spacing, to the cylinder;

a cover element opposed to the cylinder at a second spacing greater than said first spacing; and an air guide element arranged between said cover element and said carding element and so positioned that the spacing of the air guide element from the cylinder in the region of the cover element is greater than the spacing of the air guide element from the cylinder in the region of the fixed carding element.

2. An apparatus according to claim 1, comprising a cover element and an air guide element arranged upstream—seen in the direction of rotation of the cylinder—of the fixed carding element, the spacing of the upstream air guide element decreasing in the direction from the cover element towards the fixed carding element.

3. An apparatus according to claim 2, in which the spacing of the end of the upstream air guide element that is associated with the fixed carding element is the same as or smaller than the spacing between the clothing of the fixed carding element and the cylinder.

4. An apparatus according to claim 1, comprising a cover element arranged downstream—seen in the direction of rotation of the cylinder—of the fixed carding element and a downstream air guide element between the fixed carding element and the cover element, the downstream air guide element being so arranged that the spacing between the cylinder and the air guide element increases in the direction from the fixed carding element towards the cover element.

5. An apparatus according to claim 4, in which the spacing of the end of the downstream air guide element that is associated with the fixed carding element is the same as or smaller than the spacing between the clothing of the fixed carding element and the cylinder clothing.

6. An apparatus according to claim 1, in which, with respect to the cylinder clothing, the spacing of the end of a cover element that is associated with the air guide element and the spacing of the end of the air guide element that is associated with that cover element are substantially the same.

7. An apparatus according to claim 6, in which the spacing between said end of the cover element and the cylinder clothing is about $^{40}/_{1000}$", and the spacing between the cylinder clothing and the clothing of the fixed carding element is about from $^{13}/_{1000}$" to $^{15}/_{1000}$".

8. An apparatus according to claim 1, in which the spacing of the air guide element with respect to the cylinder clothing is adjustable.

9. An apparatus according to claim 8, in which an end of a said air guide element that faces the cover element is mounted on a pivot bearing, whereby the angle between the air guide element and a tangent on the cylinder clothing is adjustable.

10. An apparatus according to claim 1, in which the spacing of the air guide element with respect to the cylinder clothing is automatically adjustable by means of a drive device.

11. An apparatus according to claim 1, in which the spacing, with respect to the cylinder clothing, of the end of the air guide element that faces the fixed carding element is adjustable.

12. An apparatus according to claim 1, in which said fixed carding element has at least one clothing strip.

13. An apparatus according to claim 1, in which said air guide element is a separate component.

14. An apparatus according to claim 1, in which said air guide element is at least partly integrated into a frame of the fixed carding element.

15. An apparatus according to claim 1, in which at least one said air guide element consists of a flat plate.

16. An apparatus according to claim 1, in which at least one said air guide element has a curved surface region which faces the cylinder clothing.

17. An apparatus according to claim 1, in which there is a clothing on the surface of the air guide element that faces the cylinder clothing.

18. An apparatus according to claim 1, in which the air guide element forms a part of the cover element.

19. An apparatus according to claim 1, in which there is a said air guide element arranged in the preliminary carding zone.

20. An apparatus according to claim 1, in which there is a said air guide element arranged between the licker-in and the rear card top guide roller.

21. An apparatus according to claim 1, comprising one or more further fixed carding elements with associated cover elements and air guide element or elements.

* * * * *

UNITED STATES PATENT AND TRADEMARK OFFICE

CERTIFICATE OF CORRECTION

PATENT NO. : 7,627,931 B2
APPLICATION NO. : 11/375005
DATED : December 8, 2009
INVENTOR(S) : Breuer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 938 days.

Signed and Sealed this

Second Day of November, 2010

David J. Kappos

David J. Kappos
*Director of the United States Patent and Trademark Office*